US006148749A

United States Patent [19]

Hayashi

[11] Patent Number: 6,148,749

[45] Date of Patent: Nov. 21, 2000

[54] WORK-SHEET FEED DEVICE FOR SEWING MACHINE

[75] Inventor: Koji Hayashi, Gifu-ken, Japan

[73] Assignee: Brother Kogyo Kabushiki Kaisha, Nagoya, Japan

[21] Appl. No.: 09/329,292

[22] Filed: Jun. 10, 1999

[30] Foreign Application Priority Data

Jun. 18, 1998 [JP] Japan ..... 10-171426

[51] Int. Cl.[7] ..... D05C 9/06; D05B 21/00; D05B 25/00

[52] U.S. Cl. ..... 112/103; 112/155; 112/470.14

[58] Field of Search ..... 112/103, 102.5, 112/155, 470.06, 470.14, 470.09; 38/102.2

[56] References Cited

U.S. PATENT DOCUMENTS 5,005,501 4/1991 Kita ..... 112/103 X
5,408,944 4/1995 Hayashi ..... 112/103
5,630,370 5/1997 Herbach ..... 112/103
5,887,536 3/1999 Hayashi .

*Primary Examiner*—Peter Nerbun
*Attorney, Agent, or Firm*—Oliff & Berridge, PLC

[57] ABSTRACT

A work-sheet feed apparatus in which an X carriage is coupled integrally with a coupling member. A rear end portion of a holder support is coupled to the coupling merber via a coupling mechanism that supports the holder support pivotally about an axis parallel to the X direction, while a work-sheet holding frame that holds a work sheet is attached only at one side thereof to a frame holder secured to the holder support. With this arrangement, when a base frame vibrates in the vertical direction during embroidering, due to vertical movement of the needle bars or the presser feet during embroidering, the vertical vibration is dampened or isolated by the coupling mechanism, and is not transmitted to the holder support Because the work sheet held by the work-sheet holding frame does not vibrate in the vertical direction, threads are sufficiently tightened during the formation of the stitches on the work sheet, with no occurrence of stitch skipping or thread breakage, thus making it possible to form high-quality stitches.

20 Claims, 10 Drawing Sheets

WORK-SHEET FEED DEVICE FOR SEWING MACHINE

BACKGROUND OF THE INVENTION

1. Field of the Invention

The invention relates to a work-sheet feed device for a sewing apparatus provided with a cylinder bed or beds and, in particular, to such a work-sheet feed device in which a holder support supporting a frame holder to which a work-sheet holding frame is attached is coupled to a carrier for moving the holder support, via a coupling mechanism that serves to dampen or isolate vertical vibration transmitted from the sewing apparatus, and reduce vibration or noise upon collision of the work-sheet holding frame with the cylinder bed, without affecting stitches formed on a work sheet mounted in the work-sheet holding frame.

2. Description of the Related Art

A known example of a work-sheet feed device for an industrial sewing apparatus for forming sewing patterns or embroidery patterns is disclosed in U.S. Pat. No. 5,887,536, that is assigned to the same assignee as the present application. In this example, an X movable frame extends in the X direction, or lateral direction, perpendicular to cylinder beds of a multi-head embroidering machine equipped with three embroidering devices or units, and a Y-direction feed mechanism is provided for moving the laterally opposite end portions of the X movable frame in the Y direction. Also, an X-direction feed mechanism is provided on a second movable frame of the X movable frame, for moving an X carriage in the X direction, and a coupling plate is provided for coupling the X carriage to a first movable frame that extends in the lateral direction. In addition, a pair of left and right frame holders that support a work-sheet holding frame for a cylindrical object are attached to the first movable frame so that the work-sheet holding frame can be moved by the X-direction and Y-direction drive mechanism in the lateral (left-to-right) direction and front-to-back direction.

In the work-sheet feed device as disclosed in U.S. Pat. No. 5,887,536, the driving force of a sewing motor is applied to needle bars of the respective embroidering devices through a main drive shaft, so as to drive the needle bars at the same time in the vertical direction, and a presser foot for embroidering, provided in each embroidering device, is driven in the vertical direction in concert with the needle bar. As a result, vertical vibration caused by the vertical movement or oscillation of the needle bars and presser feet is transitted from a main body frame to the second movable frame or X carriage, and futher to the work-sheet holding frame via the first movable frame or frame holder, whereby the work-sheet holding frame itself vibrates in the vertical direction.

Where work-sheet feed operations are repeatedly performed in the same sewing direction at substantially the same feed pitch, or the work-sheet holding frame is used for a cylindrical object and thus supported only at one end portion thereof, the main body is liable to resonate, thus increasing the vertical vibration. In particular, the vertical vibration of the work-sheet holding frame may be further increased depending upon the sewing speed, resulting in increased noise occurring upon collision of the work-sheet holding frame with the cylinder bed located underneath. In addition, the work sheet mounted in the work-sheet holding frame undergoes vertical vibration, which tends to cause poor thread tightening, stitch skipping, or even thread breakage.

SUMMARY OF THE INVENTION

It is therefore an object of the invention to provide a work-sheet feed device for a sewing machine, which is able to suppress vertical vibration of a work-sheet holding frame so as to reduce noise caused by the work-sheet holding frame, and to prevent stitch skipping or thread breakage, while assuring improved thread tightness, thereby improving the quality of stitches formed on the work sheet.

To accomplish the above object, the invention provides a work-sheet feed device for a sewing apparatus, which comprises a moving mechanism that freely moves a carriage in a plane; a frame holder to which a work-sheet holding frame is to be attached; and a coupling mechanism that couples the frame holder to the carriage, wherein the coupling mechanism is constructed so as to dampen vertical vibrations received from the carriage.

In the work-sheet feed device structured as described above, the carriage is moved or driven by the moving mechanism in a certain plane. Because the carriage is coupled to the frame holder via the coupling mechanism, the driving force applied to the carriage is transmitted to the work-sheet holding frame through the frame holder and coupling mechanism, so as to move the work-sheet holding frame in the relevant plane. In this operation, even where the main body frame of the sewing apparatus vibrates in the vertical direction, due to vertical movement or oscillation of a needle bar or presser foot for embroidering, the vertical vibration can be dampened or isolated by the coupling mechanism without being transmitted to the frame holder.

According to another aspect of the invention, a work-sheet feed device for a sewing apparatus is provided which comprises an X-Y moving mechanism that freely moves a carriage in an X-Y plane; a frame holder to which a work-sheet holding frame is to be attached; and a coupling mechanism that couples the frame holder to the carriage such that the frame holder is pivotally movable in a vertical direction.

In the work-sheet feed device structured as described above, the carriage is moved or driven by the moving mechanism in the X-Y plane. Since the carriage is coupled to the frame holder via the coupling mechanism, the driving force applied to the carriage is transmitted to the work-sheet holding frame through the frame holder and coupling mechanism, so as to move the work-sheet holding frame in the X-Y plane. In this operation, even where the main body frame of the sewing apparatus vibrates in the vertical direction, due to vertical movements or oscillation of a needle bar or presser foot for embroidering, the vertical vibration can be dampened or isolated by the coupling mechanism that couples the frame holder vertically pivotally with respect to the carriage, and thus is not transmitted to the frame holder.

According to a further aspect of the invention, a work-sheet feed device for a sewing machine is provided which comprises a movable member that extends in a horizontal plane in a first direction that is perpendicular to a cylinder bed of the sewing apparatus; a first feed mechanism that moves the movable member in a second direction parallel to the cylinder bed; a carriage mounted on the movable member; a second feed mechanism that moves; the carriage in the first direction relative to the movable member; a frame holder to which a work-sheet holding frame is to be attached; a holder support that is coupled with and supports the frame holder; a coupling member that is attached to the carriage such that the coupling member and the carriage are movable as a unit, the coupling member coupling the holder support to the carriage; and a coupling mechanism that couples a proximal end portion of the holder support to the coupling member such that the holder support is pivotally movable about an axis parallel to the first direction.

In the work-sheet feed device structured as described above, the movable member on which the carriage is mounted is driven by the first feed mechanism to move in the second direction, and also driven by the second feed mechanism to move in the first direction. As the proximal end portion of the holder support is pivotally coupled to the carriage via the coupling member and coupling mechanism that are attached to the carriage, the driving force is transmitted from the holder support to the work-sheet holding frame through the frame holder and coupling member and coupling mechanism, so as to move the frame in the first and second directions. In this operation, even where the main body frame of the sewing, apparatus vibrates in the vertical direction, due to vertical movement of a needle bar or presser foot for embroidering, the vertical vibration can be dampened or isolated by the coupling mechanism capable of supporting the proximal portion of the holder support pivotally about an axis parallel to the first direction, and thus not transmitted to the frame holder.

Even in the case where the work-sheet holding frame is used for a cylindrical object, and is supported at only one side portion thereof by the frame holder, the work sheet mounted in the work-sheet holding frame does not vibrate in the vertical direction since vertical vibration arising at the main body frame is suppressed by the coupling mechanism and prevented from being transmitted to work-sheet holding frame. Consequently, threads are sufficiently tightened during the formation of stitches on the work sheet, and no stitch skipping nor thread breakage occurs, making it possible to form high-quality stitches.

In addition, owing to the suppression of vertical vibration of the work-sheet holding frame, it is possible to reduce vibration or noise that would occur upon collision of the work-sheet holding frame with the cylinder bed located underneath.

In one preferred form of the invention, the above-indicated coupling mechanism includes a height position adjusting mechanism capable of adjusting a height or vertical position of the proximal end portion of the holder support. In this case, the height position of the proximal portion of the holder support is adjusted by the height position adjusting mechanism while the holder support is placed on the movable member, so that the degree of inclination of the holder support from the proximal end to the distal end can be changed in a seesaw fashion. This makes it possible to adjust the height position of the work-sheet holding frame attached to the frame holder, as measured from the throat plate. Consequently, the size of the clearance between the throat plate and the work sheet mounted in the work-sheet holding frame can be adjusted to an optimum value, with the result of reduced vibration or noise due to vertical motion of presser feet for embroidering.

In another preferred form of the invention, the coupling member includes a restricting portion that determines an upper-limit position of upward pivotal movement of the frame holder relative to the coupling member. In this case, the upper-limit position of upward pivotal movement of the holder support relative to the coupling member is determined by the restricting portion, and therefore the upper pivotal movement of the holder support is restricted to within a certain range when the work-sheet holding frame is attached to or detached from the frame holder. This arrangement simplifies a procedure of lifting up the work-sheet holding frame, and disengaging the frame from the frame holder for detachment thereof.

In a further preferred form of the invention, the above-indicated height position adjusting mechanism includes a pair of elongate bolt holes whose long sides extend in a vertical direction, and a pair of bolt members inserted through the elongate bolt holes. In this case, adjustment of the height position of the proximal portion of the holder support can be easily accomplished only through engagement of the bolt members with the elongate bolt holes formed through either one of the coupling member and the proximal end portion of the holder support.

In a still another preferred form of the invention, the height position adjusting mechanism includes a pair of bolt holes, and a pair of eccentric bolts inserted through the bolt holes. In this case, fine adjustment of the height position of the proximal portion of the holder support can be easily accomplished only through engagement of the eccentric bolts with the bolt holes formed through either one of the coupling member and the proximal end portion of the holder support.

BRIEF DESCRIPTION OF THE DRAWINGS

The invention will be described in greater detail with reference to certain preferred embodiments thereof and the accompanying drawings, wherein.

DETAILED DESCRIPTION OF THE PREFERRED EMBODIMENTS

One preferred embodiment of the invention will be described with reference to the drawings. In this embodiment, the invention is applied to a multi-head embroidering machine including three embroidering devices or units.

Figure 1:
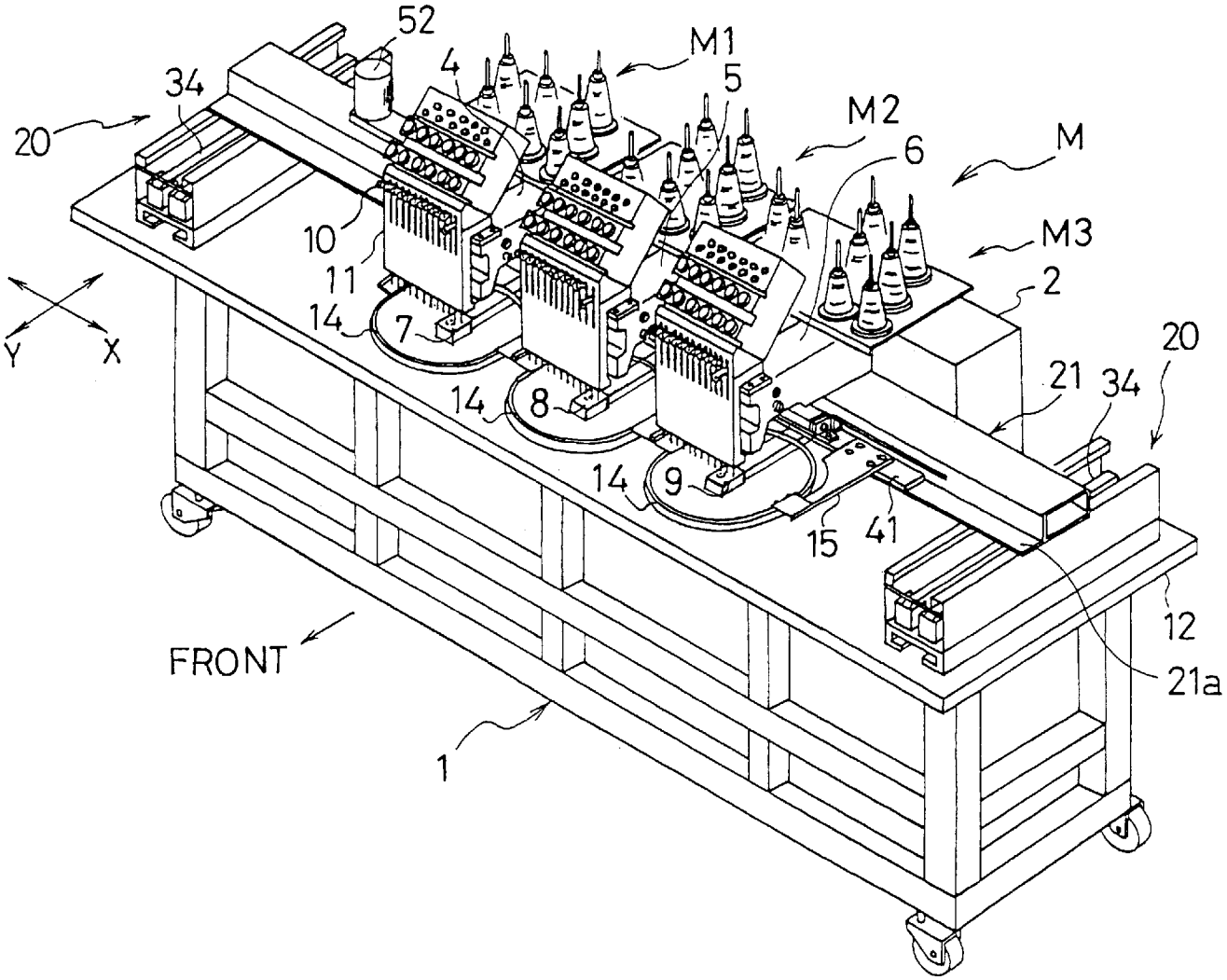
FIG. 1 is a perspective view showing a multi-head embroidering machine.

The multi-head embroidering machine M will be described first. As shown in FIG. 1, a common support frame 2 that extends in the lateral direction is mounted on a rear portion of the upper surface of a base frame 1 that extends in the lateral direction. Three head portions 4, 5, 6, which are mounted on the support frame 2, are arranged in parallel with each other such that the head portions 4–6 are spaced from each other at fixed intervals in the lateral direction. Also, cylinder-like bed portions 7–9 are supported at their rear end portions by the base frame 1 such that the bed portions 7–9 extend in the Y direction in alignment with the respective head portions 4–6.

The three multi-needle type embroidering devices M1–M3 that comprise the head portions 4–6 mounted on the support frame 2 and the bed portions 7–9 corresponding to the head portions 4–6 are arranged in parallel with each other. Needle-bar cases 11 are supported at front erd portions of the respective head portions 4–6 of the embroidering devices M1–M3 such that the cases 11 are movable in the lateral direction. Each of the needle-bar cases 11 supports twelve needle bars (not shown) arranged in a row in the lateral direction, allowing vertical movement or oscillation of the needle bars, and also supports twelve needle thread take-up levers 10, allowing swinging motion of the levers . All of the needle-bar cases 11 may be moved at the same time in the lateral direction by means of a needle-bar changing mechanismr. that is driven by a needle-bar change motor (not shown), so as to enable changes of colors of embroidery threads supplied for embroidering.

A base plate 12 is disposed on the upper side of the base frame 1 to extend in the horizontal plane, and two Y-direction feed mechanisms 20 (corresponding to the first feed mechanism) are respectively provided, at the laterally opposite end portions of the base plate 12, for moving a generally plate-like movable member 21 in the Y direction (corresponding to the second direction). The movable member 21 extends in the lateral direction, and serves to move three work-sheet holding frames 14.

Each of the embroidering devices M1–M3 is provided with a needle-bar driving mechanism that applies the driving force of a sewing motor (not illustrated) to the needle bars through a main shaft so as to move the needle bars in the vertical direction, and a needle-bar jump mechanism that causes the needle-bars to jump up to the needle-up position so as to move a selected one of the twelve needle bars in the vertical direction. These mechanisms are similar to those of conventional embroidering machines, and therefore will not be described herein. The bed portions 7–9 are respectively provided with shuttles for loop catchers, which cooperate with vertical moving sewing needles to form stitches. This arrangement is widely known in the art, and thus will not be described in detail.

A work-sheet feed device for driving the three work-sheet holding frames 14 corresponding to the respective embroidering machines M1–M3 will now be described. The work-sheet feed device is adapted to move or drive the three work-sheet holding frames 14 independently in the X direction (corresponding to the first direction, or lateral direction) and the Y direction.

Figure 2:
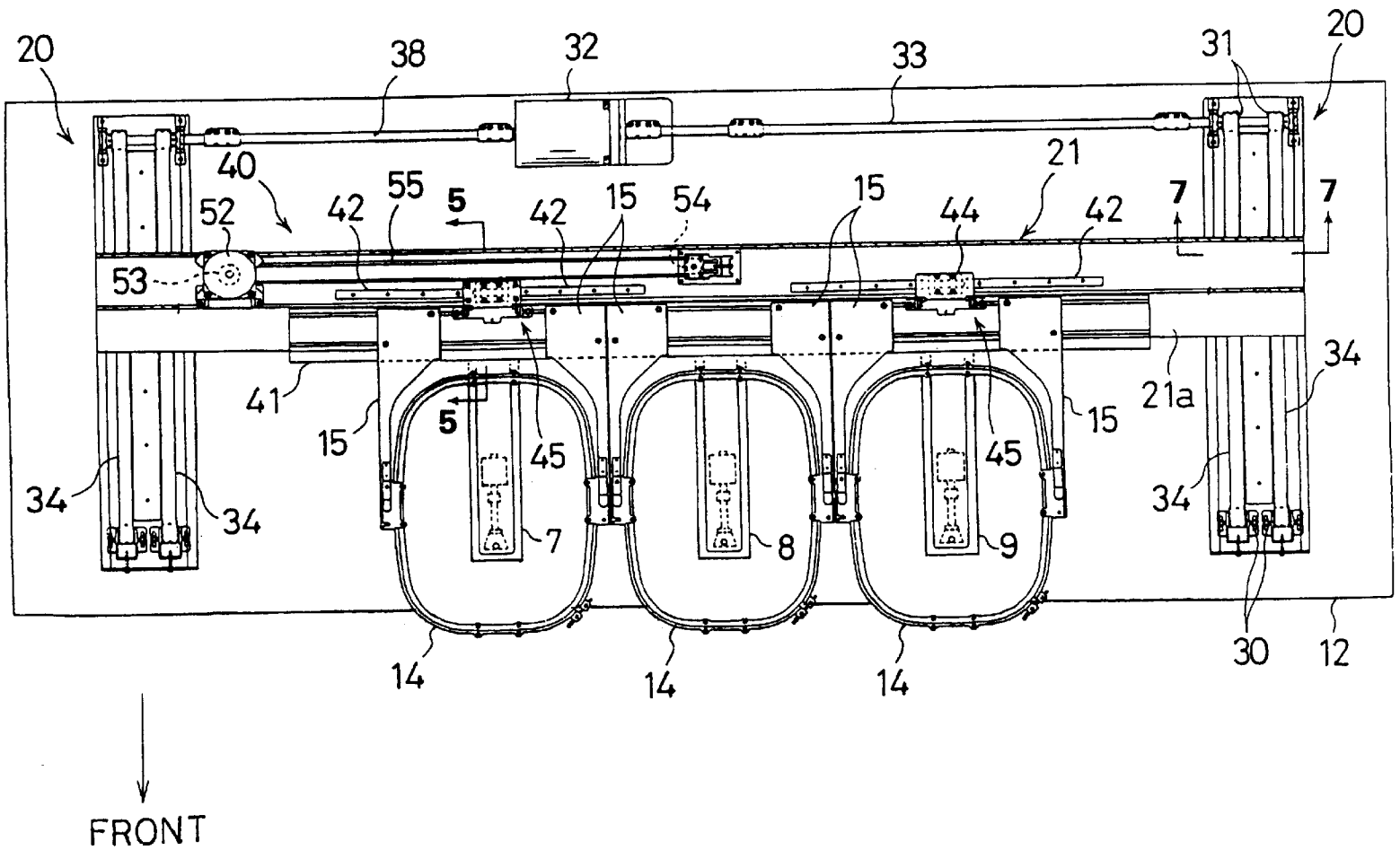
FIG. 2 is a plan view showing a work table and bed units.
Figure 7:
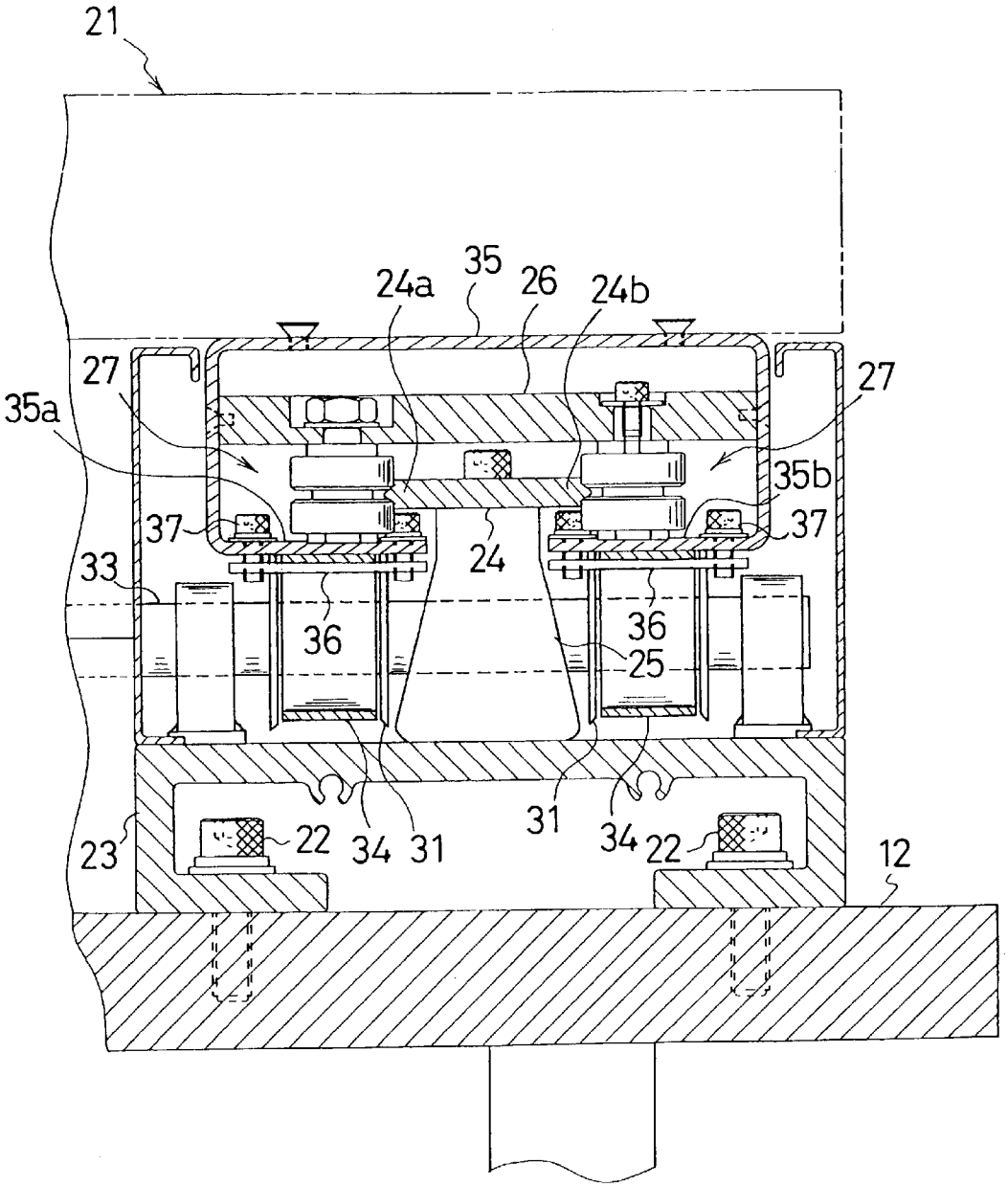
FIG. 7 is a front view showing a vertical cross section taken along line 7—7 of FIG. 2.

Referring to FIGS. 2 and 7, there will be described a pair of Y-direction feed mechanisms 20 adapted to drive the left- and right-hand end portions of the laterally extending movable member 21 in a synchronous manner, so as to feed the movable member 21 in the Y direction. Because the opposite Y-direction feed mechanisms 20 have substantially the same structure, only the right-hand side Y-direction feed mechanism 20 will be described.

As shown in FIGS. 2 and 7, a base 23 is secured to the right-hand end portion of the base plate 12 by means of bolts 22 to extend in the longitudinal direction of the Y- direction feed mechanism 20, and a guide member 24 in the form of a horizontal strip-like plate having a certain width is disposed above the base 23 to extend in the Y direction in the horizontal plane. The guide member 24 is fixed by screws to a plurality of support blocks 25 that are attached to the base 23 and arranged in the longitudinal direction of the Y-direction feed mechanism 20 at fixed intervals. A Y carriage 25 in the form of a generally rectangular plate member, as viewed in the thickness direction thereof, is disposed horizontally right over the guide member 24. Four rotary members 27, that are freely rotatable about their vertical axes, engage with laterally opposite guide portions 24*a*, 24*b* of the guide member 24 located inside the rotary members 27. With this arrangement, the Y carriage 26 is able to move in the Y direction along the guide member 24.

A pair of right and left driven pulleys 30 are rotatably supported on the front end of the guide member 24, and a pair of right and left driving pulleys 31 are rotatably supported on the rear side of the guide member 24. Each of the driving pulleys 31 is fixed to a driving shaft 33 that is coupled to a Y-direction drive motor 32 located at a substantially middle part of the rear end portion of the base plate 12. A timing belt 34 extends around each of the driving pulleys 31 and a corresponding one of the driven pulleys 30.

A generally C-shaped Y driving frame 35, as viewed from the front side, is attached to the Y carriage 26 so as to cover or surround the carriage 26. The left-hand side timing belt 34 is fixed at one end portion thereof to a left-hand side mounting portion 35*a* of the Y driving frame 35 by means of a pressure plate 36 and a screw 37. Similarly, the right-hand side timing belt 34 is fixed at one end portion thereof to a right-hand side mounting portion 35*b* of the Y driving frame 35 by means of a pressure plate 36 and a screw 37.

In operation, when the Y-direction drive motor 32 is driven, the driving force is transmitted to the pair of timing belts 34 via the driving shaft 33 and the pair of driving pulleys 31 located on the right-hand side of the shaft 33, so that the timing belts 34 are rotated in synchronism with each other. As a result, the right-hand side Y driving frame 35 coupled to the timing belts 34 is moved in the Y direction along the guide member 24. In a similar manner, the left-hand side Y driving frame 35 is moved in the Y direction along the guide member 24 by means of the left-hand side Y direction feed mechanism 20 that receives the driving force of the Y direction drive motor 32 through the driving shaft 38. In this manner, the movable member 21 that is mounted on the opposite Y drive frames 35 is moved in the Y direction.

Figure 3:
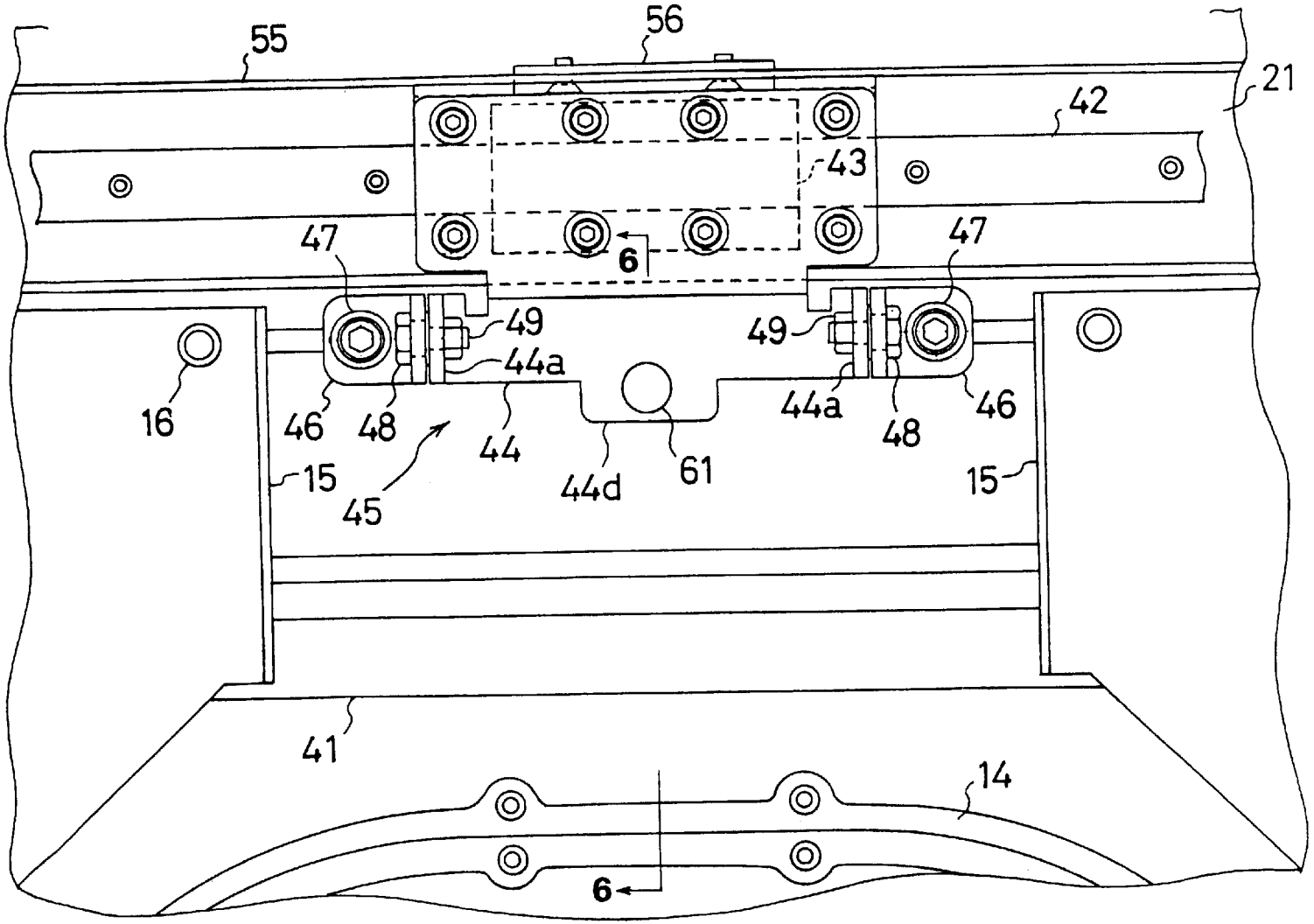
FIG. 3 is a plan view of an enlarged principal part of FIG. 2.
Figure 5:
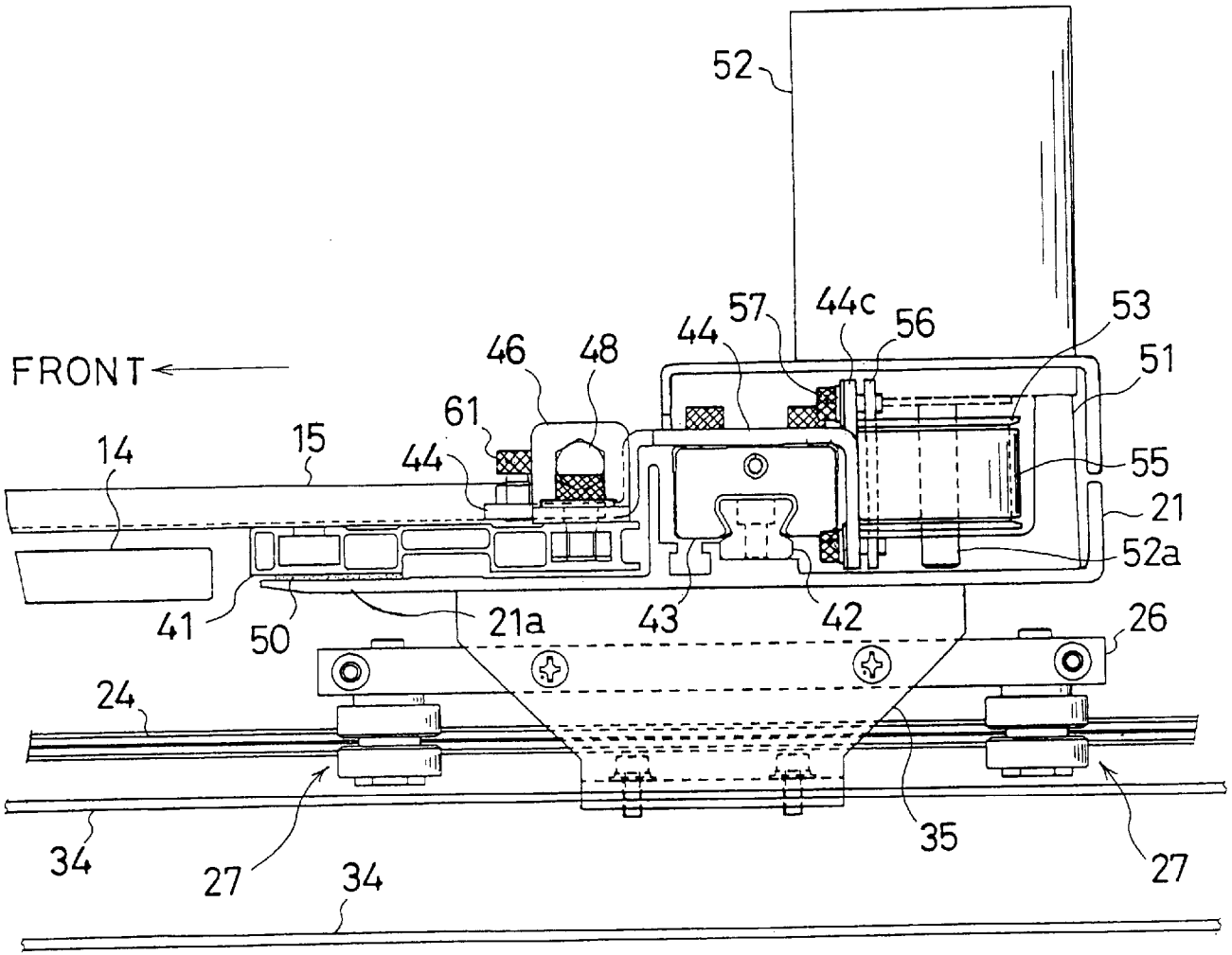
FIG. 5 is a side view showing a vertical cross section taken along line 5—5 of FIG. 2.

Referring next to FIGS. 2, 3, and 5, an X-direction feed mechanism (corresponding to the second feed mechanism) 40 provided on the movable member 21 will be described in detail.

A holder support 41 in the form of a plate member that extends in the lateral direction is mounted on a horizontal slide portion 21*a* as a front-half portion of the movable member 21, such that the holder support 41 is slidable in the lateral direction along the slide portion 21*a*. A pair of guide rails 42 are fixed to right and left portions of the movable member 21 immediately behind the slide portion 21*a*, to extend in the X direction. An X carriage 43 is slidably disposed on each of the guide rails 42 to partially surround and engage with the guide rail 42, as shown in FIG. 5.

A coupling member 44, in the form of a plate member, is secured at its rear end portion to each of the X carriages 43. The coupling member 44 includes a generally front-half portion that is bent into a crank-like shape to be stepped down with respect to a rear-half portion of the coupling member 44, as shown in the side view of FIG. 5. The rear end portion (corresponding to the proximal end portion) of the holder support 41 is coupled to the front-half portion of the coupling member 44 via a coupling mechanism 45, such that the height position of the support 41 is adjustable and the support 41 is pivotally movable relative to the coupling member 44.

Figure 4:
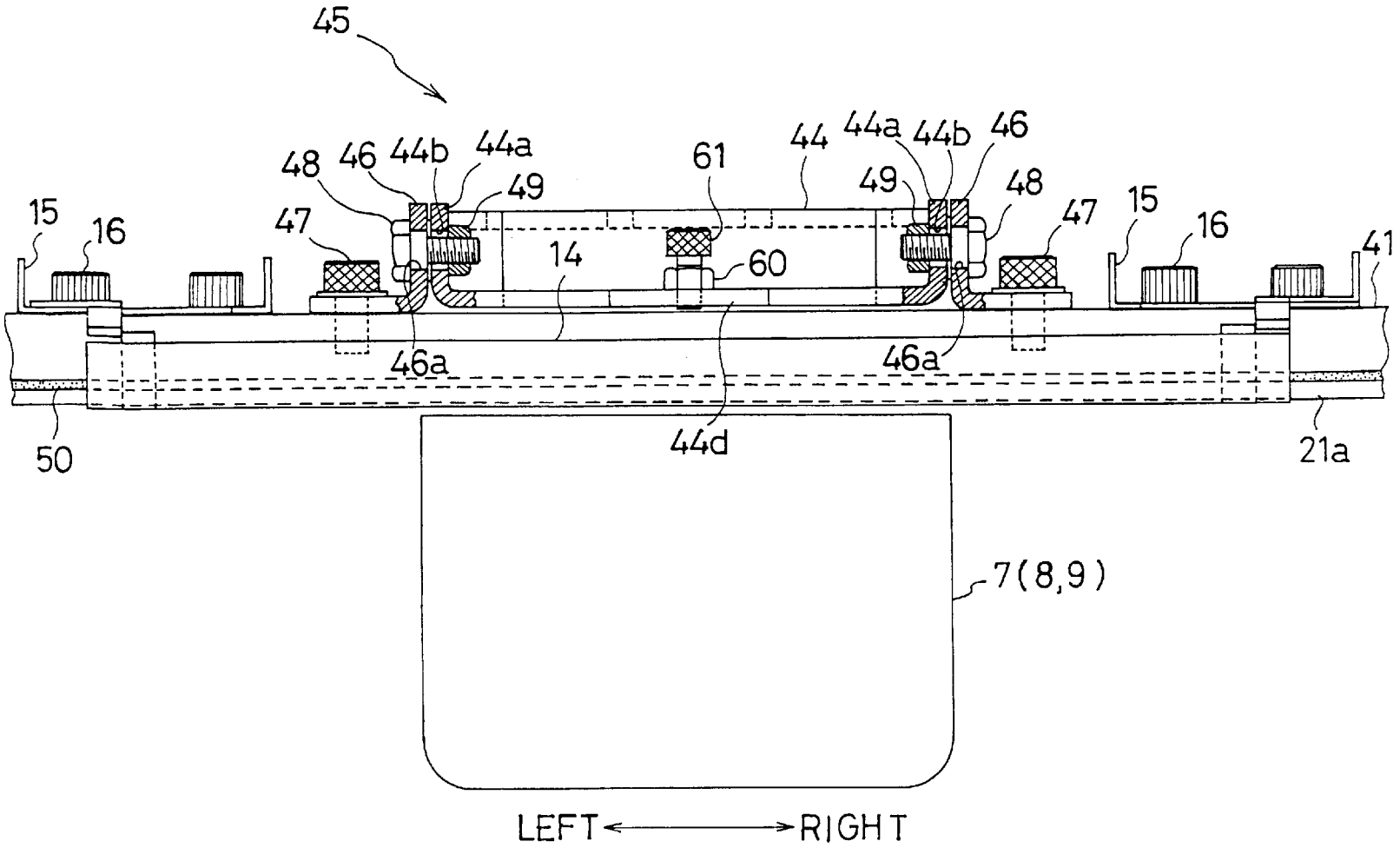
FIG. 4 is a front view showing a part of the multi-head embroidering machine of FIG. 1.
Figure 6:
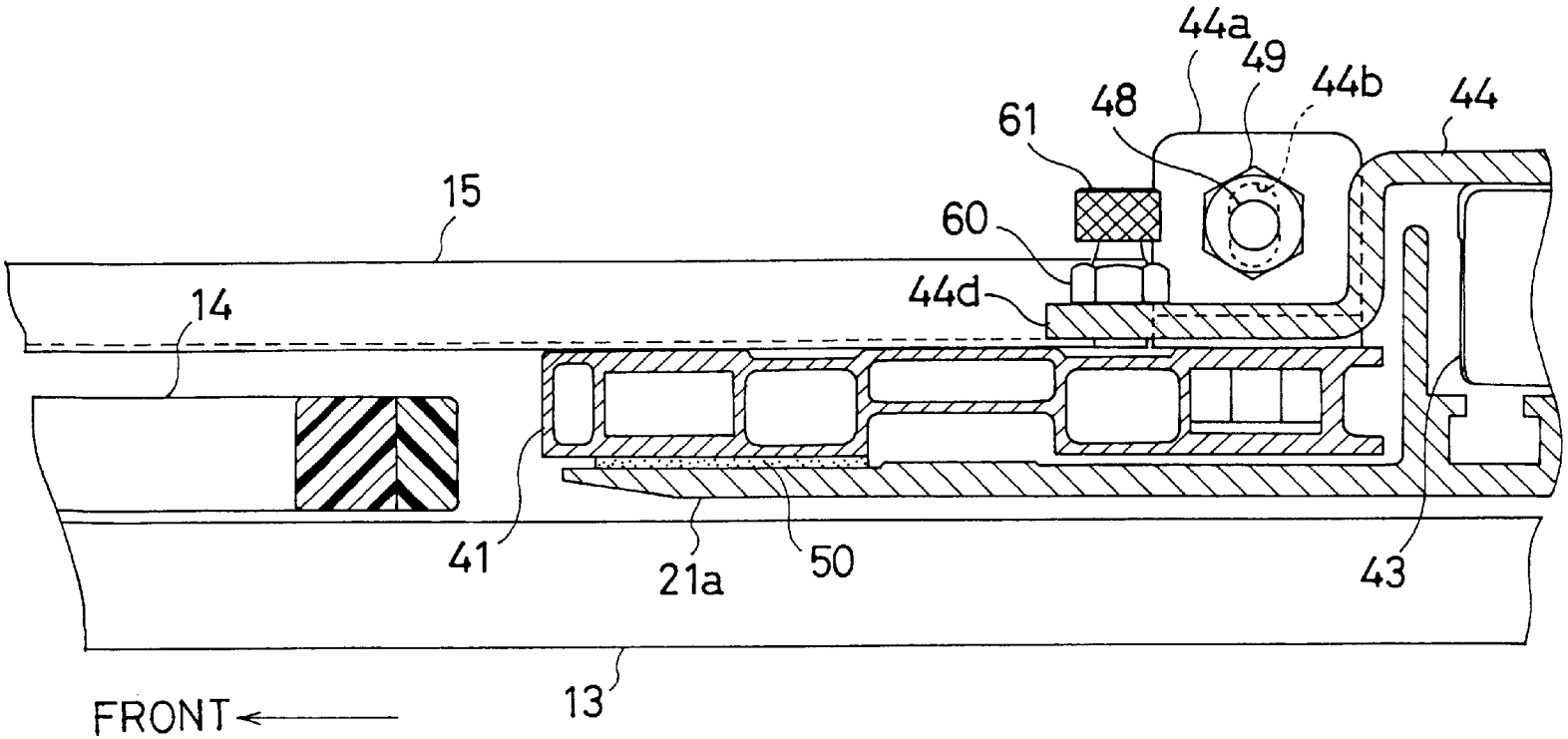
FIG. 6 is a side view showing a vertical cross section taken along line 6—6 of FIG. 3.

The coupling mechanism 45 will be now described in detail. As shown in FIGS. 3 through 6, the coupling member 44 includes vertical flanges 44*a* formed by bending upwards laterally opposite end portions of the front-half portion of the coupling member 44. Each of the vertical flanges 44*a* is formed with an oval bolt hole 44*b* whose long side extends in the vertical direction, as shown in FIGS. 4 and 6.

On the other hand, generally L-shaped brackets 46 are mounted on the holder support 41 to be located outwardly of the vertical flanges 44*a*. Each bracket 46 includes a horizontal wall portion that is fixed to the holder support 41 by a fixing screw 47, and a vertical wall portion that has a circular bolt hole 46*a*. A stepped bolt 48 is inserted through the bolt hole 46*a* of each bracket 46 and the corresponding oval bolt hole 44*b* of the coupling member 44, and fixed to the vertical flange 44*a* by a nut 49. The stepped bolt 48 includes a large-width stepped portion that is slightly larger than the width of the vertical wall portion of the bracket 46. With this arrangement, the bracket 46 is pivotally movable with respect to the stepped bolt 48, and, consequently, the supported holder support 41 is pivotally movable relative to the coupling member 44 about an axis parallel to the X direction. In the present embodiment, the above-indicated pair of oval bolt holes 44*b*, the pair of stepped bolts 48 and the nuts 49, constitute a vertical location adjusting mechanism.

With the above arrangement, the height position of the rear end portion of the holder support 41 can be set by adjusting the height position of the stepped bolts 48 within the oval bolt holes 44. Also, the front end portion of the holder support 41 is mounted on the slide portion 21*a* via a felt sheet 50 bonded to the lower surface of the holder support 41, so that the inclination of the holder support 41 in the front-to-rear direction is determined. Each of the X carriages 43 is movable in the X direction along the corresponding guide rail 42, and the holder support 41, that is coupled to the X carriages 43 via the coupling members 44 and the coupling mechanisms 45, is movable in the X direction on the slide portion 21*a* of the movable member 21, together with the X carriages 43.

Also as shown in FIGS. 2 and 5, a mounting member 51 is fixed to a left-hand end portion of the movable member 21, and an X-direction drive motor 52 is mounted in the mounting member 51 such that its driving shaft 52*a* protrudes downwards. A driving pulley 53 is secured to the driving shaft 52*a* of the X-direction drive motor 52, and a driven pulley 54 is supported rotatably about its vertical axis at a generally middle portion of the movable member 21.

A timing belt 55 extends around the driving pulley 53 and driven pulley 54. One end portion of the timing belt 55 is connected, via fixing plate 56 and screw 57, to a fixed portion 44*c* cut from the rear end portion of the coupling member 44, as shown in FIG. 5.

As shown in FIGS. 2 and 4, three pairs of frame holders 15 corresponding to the embroidering devices M1–M3, respectively, are fixed at their rear end portions to the holder support 41 by mounting screws 16, and work-sheet holding frames 14 are attached to distal end portions of the respective pairs of frame holders 15, such that only one-half of each work-sheet holding frame 14 is supported by the corresponding pair of frame holders 15.

With this arrangement, when the X-direction drive motor 52 is driven, the driving force is transmitted to the timing belt 55 through the driving pulley 53 and driven pulley 54 so as to rotate the timing belt 55, and further transmitted to each of the X carriages 43 through the corresponding coupling member 44, of one of the X carriages coupled to the timing belt 55 so as to move the X carriages 43 in the X direction along the guide rail 42. As a result, the holder support 41 is driven to move along with the X carriages 43 in the X direction. If the Y direction drive motor 43 is driven at this time so that the laterally opposite Y driving frames 35 are noved in the Y direction in synchronism with each other, it is possible to feed the plurality of work-sheet holding frames 14 in the X direction and Y direction.

Referring to FIGS. 3–5, a restricting portion 44*d* provided above the holder support 41 will be described.

A restricting bolt 61 is screwed into a nut 60 that is secured to a laterally middle portion of the front end portion of the coupling member 44, such that a distal threaded portion of the bolt 61 protrudes downwards from the lower surface of the restricting portion 44*d*. By suitably adjusting the amount of downward protrusion of the restricting bolt 61, the upper-limit position of the holder support 41, when it pivots vertically, can be determined. More specifically, when the holder support 41 pivots vertically about a pivot center provided by the stepped bolt 48, the holder support 41 abuts on the protruding lower end of the restricting bolt 61, and thus the upward pivotal movement of the holder support 41 is limited by the restricting bolt 61.

The operation and advantages of the multi-head type embroidering machine structured as described above will be now described.

During formation of embroidery patterns, the Y-direction drive motor 32 and X-direction drive motor 52 are individually driven under control based on sewing data. More specifically, when the Y-direction feed mechanisms 20 are driven by the Y-direction drive motor 32, each of the Y drive frames 35 receives the driving force of the motor 32 through the corresponding pair of timing belts 34 thereby to move in the Y direction along the guide member 24, and the movable member 21 coupled to the opposite Y drive frames 35 is moved in the Y direction. When the X-direction feed mechanism 40 is driven by the X-direction drive motor 52, on the other hand, the X carriages 43 receive the driving force of the motor 52 through the timing belt 55, thereby to move in the X direction along the corresponding guide rails 42. As a result, the frame holders 15 secured to the holder support 41 that is coupled to the X carriages 43 are moved, thereby to feed the plurality of work-sheet holding frames 14 in the X direction and Y direction.

Here, the coupling members 44 are coupled integrally with the X carriage 43, and the rear end portion of the holder support 41 is coupled via the coupling mechanism 45 to the coupling members 44 such that the holder support 41 is pivotally movable about an axis parallel to the X axis. Further, the work-sheet holding frame 14 that holds a work sheet is attached to the frame holder 15 secured to the holder support 41 to protrude from the distal end of the frame holder 15. With this arrangement, when the base frame 1 vibrates in the vertical direction during embroidering, due to vertical motion or oscillation of needle bars and/or presser feet, the vibration of the base frame 1 is not transmitted to the holder support 41 but dampened or absorbed by the coupling mechanisms 45. This prevents the work sheets held by the work-sheet holding frames 14 from vibrating in the vertical direction. Consequently, threads are sufficiently tightened during formation of stitches on the work sheet, and stitch skipping or thread breakage does not occur, resulting in high-quality stitches formed on the work sheet. Furthermore, since the vertical vibration of the work-sheet holding frames 14 is prevented as described above, it is possible to reduce vibration or noise that occur due to collision between the work-sheet holding frames 14 and the cylinder beds 7–9 located underneath.

Figure 8:
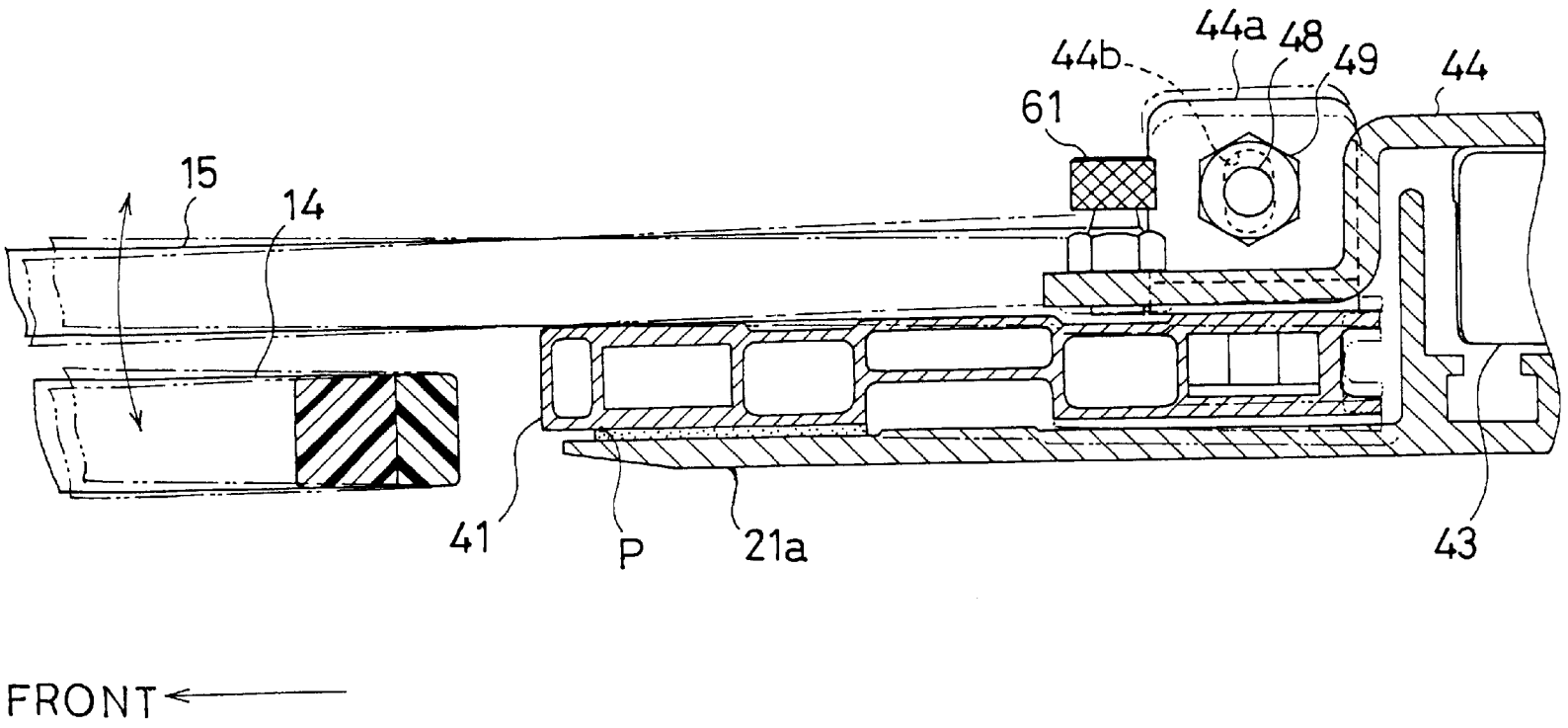
FIG. 8 is a view corresponding to that of FIG. 6, which is useful in explaining the manner of adjusting the height position of the holder support.

As shown in FIG. 8, the height position of the rear end portion of the holder support 41 can be adjusted in the vertical direction by means of the height position adjusting mechanism provided in the coupling mechanism 45, more specifically, through the stepped bolts 48 and the oval bolt holes 44*b* formed through the flanges 44*a* of the coupling member 44. Accordingly, the degree of inclination of the holder support 41 from the rear end portion to the distal end portion can be changed in a seesaw fashion, as indicated by two-dot chain line in FIG. 8, with the holder support 41 pivoting about a position P at which the holder support 41 abuts on the front end portion of the slide portion 21*a*. In this manner, the height position of the work-sheet holding frame 14 attached to the frame holder 15 as measured from a throat plate (not shown) can be adjusted, thus making it possible to optimally adjust the size of a clearance between the work sheet mounted in the work-sheet holding frame 14 and the throat plate. As a result, vibration or noise due to vertical motion of the presser feet for embroidering can be advantageously reduced.

Figure 9:
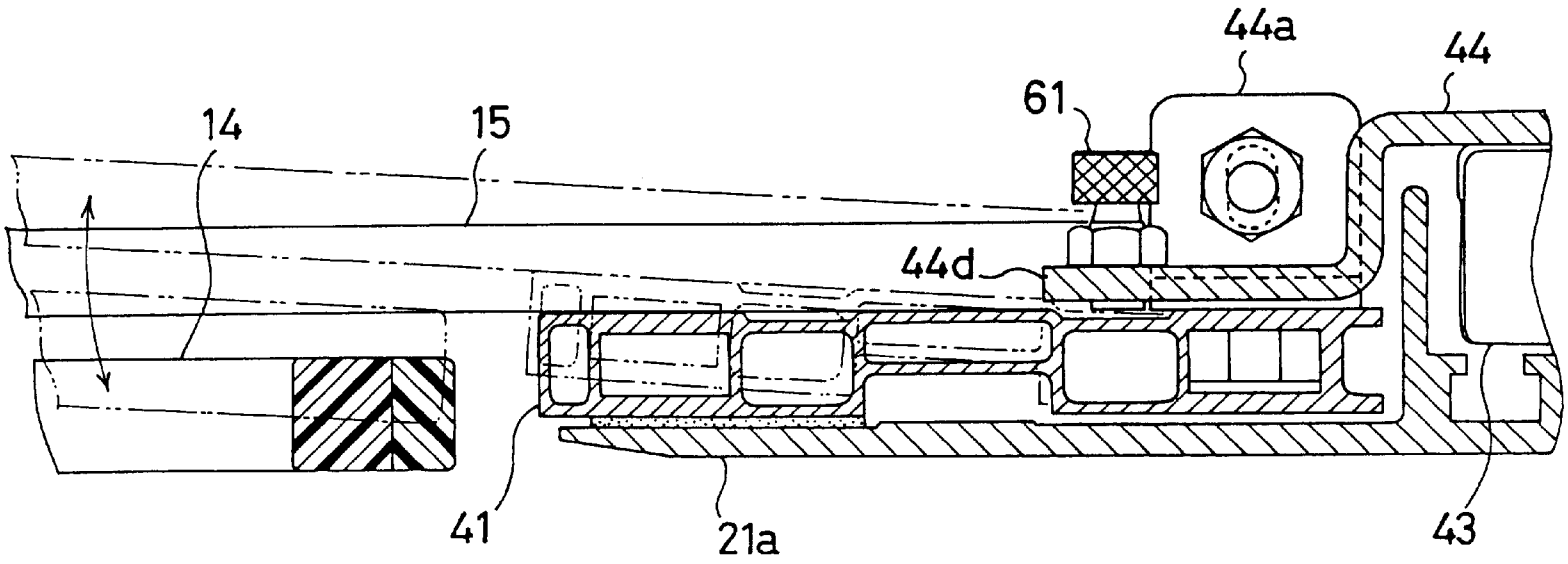
FIG. 9 is a view corresponding to that of FIG. 6, which is useful in explaining the manner of limiting upward pivotal movement of the holder support.

As shown in FIG. 9, the restricting portion 44*d* of the coupling member 44 is provided with the restricting bolt 61 that protrudes downwards from the lower surface of the restricting portion 44*d*. With this arrangement, when the holder support 41 pivots vertically about the stepped bolt 48 as indicated by two-dot chain line in FIG. 9, the upward pivotal movement of the holder support 41 is limited due to abutting contact of the holder support 41 with the protruding lower end of the restricting bolt 61. This arrangement simplifies the procedure of lifting up the work-sheet holding frame 14 and disengaging the frame 14 from the frame holder 15 for detachment of the frame 14.

Figure 10:
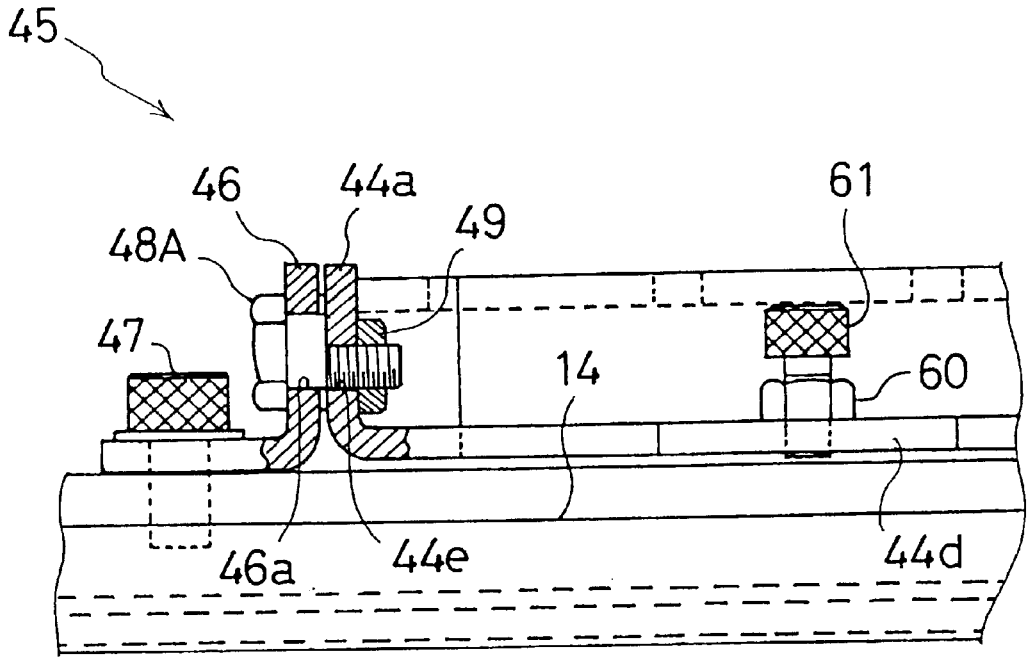
FIG. 10 is an enlarged front view showing a modified part of FIG. 4.

In the height position adjusting mechanism as described above, vertically elongate, oval bolt holes that cooperate with the stepped bolts 48 to adjust the height position of the holder plate 41 may be formed through each flange 44*a*. Also, as shown in FIG. 10, the oval bolt holes 44*b* formed through the flanges 44*a* of the coupling member 44 may be replaced by ordinary circular bolt holes 44*e*, and a pair of stepped eccentric bolts 48A may be used so that the height position of the holder support 41 can be easily and finely adjusted by rotating the stepped. eccentric bolts 48A. Also, the coupling mechanisms 45 may be provided at three or more locations.

The coupling mechanism 45 does not necessarily allow pivotal movement of the holder plate 41 in the vertical direction, but may have any other structure provided that it is able to dampen or isolate vertical vibration received from the holder support 41. For example, the coupling member may be provided with a cushioning or shock absorbing material.

The carriages are not limited to those movable in the X-Y rectangular coordinate plane, but may have any other structure provided that they can be freely movable in a certain plane. For example, the carriages may be movable in the r-polar coordinate plane.

With respect to the illustrated embodiment, various changes or modifications may be made to the structure of each mechanism on the basis of conventional technologies or those known in the art. It is also to be understood that the invention may be applied to various work-sheet feed devices of various types of multi-head sewing machines, such as those having four or more heads.

What is claimed is:

1. A work-sheet feed device for a sewing apparatus, comprising:

a moving mechanism that freely moves a carriage in a plane;

a frame holder to which a work-sheet holding frame is to be attached; and a coupling mechanism that couples the frame holder to the carriage, wherein the coupling mechanism is structured to dampen vertical vibration received from the carriage.

2. A work-sheet feed device for a sewing apparatus, comprising:

an X-Y moving mechanism that freely moves a carriage in an X-Y plane;

a frame holder to which a work-sheet holding frame is to be attached; and a coupling mechanism that couples the frame holder to the carriage such that the frame holder is pivotally movable in a substantially vertical direction.

3. The work-sheet feed device according to claim 2, further comprising a height position adjusting mechanism that adjusts a vertical position at which the frame holder is attached to the carriage.

4. The work-sheet feed device according to claim 2, further comprising a restricting member that determines an upper-limit position of upward pivotal movement of the frame holder coupled to the carriage by the coupling member.

5. The work-sheet feed device according to claim 3, further comprising a restricting member that determines an upper-limit position of upward pivotal movement of the frame holder coupled to the carriage by the coupling member.

6. The work-sheet feed device according to claim 3, wherein the height position adjusting mechanism comprises a pair of elongate bolt holes whose long sides extend in a vertical direction, and a pair of bolt members inserted through the elongate bolt holes.

7. The work-sheet feed device according to claim 3, wherein the height position adjusting mechanism comprises a pair of bolt holes, and a pair of eccentric bolts inserted through the bolt holes.

8. The work-sheet feed device according to claim 2, wherein the frame holder is supported so as to protrude from the coupling mechanism.

9. A work-sheet feed device for a sewing apparatus, comprising:

a movable member that extends in a horizontal plane in a first direction that is perpendicular to a cylinder bed of the sewing apparatus;

a first feed mechanism that moves the movable member in a second direction parallel to the cylinder bed;

a carriage mounted on the movable member;

a second feed mechanism that moves the carriage in the first direction relative to the movable member;

a frame holder to which a work-sheet holding frame is to be attached;

a holder support that is coupled with and supports the frame holder;

a coupling member that is attached to the carriage such that the coupling member and the carriage are movable as a unit, the coupling member coupling the holder support to the carriage; and a coupling mechanism that couples a proximal end portion of the holder support to the coupling member such that the holder support is pivotally movable about an axis parallel to said first direction.

10. The work-sheet feed device according to claim 9, wherein the coupling mechanism comprises a height position adjusting mechanism that is able to adjust a height position of the proximal end portion of the holder support.

11. The work-sheet feed device according to claim 9, wherein the coupling member includes a restricting portion that determines an upper-limit position of upward pivotal movement of the frame holder relative to the coupling member.

12. The work-sheet feed device according to claim 10, wherein the coupling member includes a restricting portion that determines an upper-limit position of upward pivotal movement of the frame holder relative to the coupling member.

13. The work-sheet feed device according to claim 10, wherein the height position adjusting mechanism comprises a pair of elongate bolt holes whose long sides extend in a vertical direction, and a pair of bolt members inserted through the elongate bolt holes.

14. The work-sheet feed device according to claim 11, wherein the height position adjusting mechanism comprises a pair of bolt holes, and a pair of eccentric bolts inserted through the bolt holes.

15. The work-sheet feed device according to claim 9, wherein the frame holder is supported so as to protrude from said coupling mechanism.

16. A work-sheet feed-device for a sewing machine, comprising:

at least one work-sheet holding frame;

a feed mechanism for moving the at least one work-sheet holding frame in a first direction and a second direction transverse to the first direction, the feed mechanism including a movable member extending in the first direction;

a mounting mechanism mounted to the movable member, the mounting mechanism movable in the first direction, and a holding mechanism pivotably and adjustably, in a vertical direction, mounted to the mounting mechanism, the at least one work-sheet holding frame mounted to the holding mechanism.

17. The work-sheet feeding device according to claim 16, wherein the mounting mechanism comprises:

at least one carriage; and a connecting member fixedly attached to each carriage of the at least one carriage, each connecting member including a vertically extending flange at each end relative to the first direction and a restricting portion extending transverse to the first direction at substantially a mid-point between the vertically extending flanges, a bolt hole formed in each vertically extending flange.

18. The work-sheet feeding device according to claim 17, wherein the holding mechanism comprises:

a holder support extending in the first direction;

a plurality of L-shaped brackets mounted to the holder support, each L-shaped bracket having a bolt hole and positioned to oppose one of the vertically extending flanges of each connecting member, the L-shaped brackets bolted to the vertically extending flanges to permit the pivotal movement; and a pair of frame holders for each work-sheet holding frame of the at least one work-sheet holding frame, the each pair of frame holders fixedly mounted to the holder support and mounting the work-sheet holding frame there between.

19. The work-sheet feeding device according to claim 18, wherein the vertical adjustment of the holding mechanism is provided by one of the bolt hole in the vertically extending flanges being vertically elongated and the bolts connecting the vertically extending flanges with the L-shaped brackets being eccentric.

20. The work-sheet feeding device according to claim 18, wherein the restricting portion has an adjusting an mechanism comprising an adjustment bolt threadably received in the restricting portion for vertical adjustment, the adjustment bolt lower end restricting pivotal movement of the holder support.

* * * * *